US009271529B2

(12) United States Patent
Alima

(10) Patent No.: US 9,271,529 B2
(45) Date of Patent: Mar. 1, 2016

(54) PORTABLE VAPORIZATION APPARATUS

(71) Applicant: Yariv Alima, Plantation, FL (US)

(72) Inventor: Yariv Alima, Plantation, FL (US)

(73) Assignee: Atmos Nation LLC, Davie, FL (US)

( * ) Notice: Subject to any disclaimer, the term of this patent is extended or adjusted under 35 U.S.C. 154(b) by 229 days.

(21) Appl. No.: 13/949,747

(22) Filed: Jul. 24, 2013

(65) Prior Publication Data

US 2014/0216483 A1 Aug. 7, 2014

Related U.S. Application Data

(60) Provisional application No. 61/760,757, filed on Feb. 5, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 8,910,639 B2 * 12/2014 Chang et al. ..... 131/273
2014/0174458 A1 * 6/2014 Katz ..... 131/200
2014/0270726 A1 * 9/2014 Egoyants ..... A24F 47/004 392/386

* cited by examiner

*Primary Examiner* — Michael H Wilson
*Assistant Examiner* — Dionne Walls Mayes

(57) ABSTRACT

A portable vaporization apparatus is a is a compact re-useable apparatus that attaches to an existing electrical source, such as a battery pack of an existing electronic cigarette/personal vaporizer, in order to vaporize a plurality of dried solid compounds as well as liquid compounds with a low viscosity into an inhalable aerosol. The portable vaporization apparatus utilizes a mouth piece, a lower housing which contains an interior chamber, a battery mount, and a wickless ceramic heating element. The ceramic heating element is securely engaged to the battery mount which is engaged to the lower housing forming a hermetic seal at the lower portion. The ceramic heating element is positioned within the interior chamber while the upper portion of the interior chamber is temporarily sealed by the mouth piece. With vaporizable material in the interior chamber, the user would connect the electrical source powering the ceramic heating element.

12 Claims, 6 Drawing Sheets

PORTABLE VAPORIZATION APPARATUS

The current application claims a priority to the U.S. Provisional Patent application Ser. No. 61/760,757 filed on Feb. 5, 2013.

FIELD OF THE INVENTION

The present invention relates generally to a smoking device. More specifically, to a reusable electrically powered vaporization chamber that attaches to portable electrical source. The present invention is specifically designed for use in vaporizing a plurality substances in various states physical state.

BACKGROUND OF THE INVENTION

It is regarded as common knowledge that electrically powered smoking devices can be utilized as a combustion free alternative to existing tobacco smoking devices. These electrically powered smoking devices exist in a plurality of configurations, whose selected construction is generally dependent on the level of portability. One of the most common variants is electronic cigarettes, as known as personal vaporizers. Electronic cigarettes are portable vaporization devices that produce an inhalable aerosol that typically contains nicotine. Generally, electronic cigarettes/personal vaporizers comprise a mouth piece, an atomizer, an electrical source, and a reservoir containing a liquid compound. Of these components, the atomizer is key to the operability of the electronic cigarettes/personal vaporizers. The atomizer is the heating element that vaporizes the liquid compound into the inhalable aerosol. It is positioned between the reservoir and the mouth piece. Typically, atomizers in electronic cigarettes/personal vaporizers incorporate a heated passage that uses capillary action to draw the liquid compound through the atomizer and into the mouth piece. When an electrical current is applied to the system, the atomizer heats up and draws the liquid compound through the heated passage. The liquid compound is vaporized while traversing the atomizer and upon exiting into the mouth piece forms an inhalable aerosol.

While electronic cigarettes/personal vaporizers offer an adequate combustion free alternative to existing tobacco smoking devices, their current design suffers from a lack versatility with regards to the vaporizing compounds. Generally, electronic cigarettes/personal vaporizers are limited to vaporizing highly viscous liquid compounds. This limitation is due to the component arrangement requiring the vaporizable compounds to traverse through the atomizer in order to form the inhalable aerosol. Although alternative means of vaporizing compounds exist, an effective component arrangement for an apparatus or apparatus attachment of similar size and construction to existing electronic cigarettes/personal vaporizers is not currently available. While some variants claim to vaporize dried solid compounds or liquid compounds with a low viscosity, most in fact combust the compounds, negating the purpose of the electronic cigarettes/personal vaporizers.

It is therefore the object of the present invention to provide an apparatus sized similarly to existing electronic cigarettes/personal vaporizers that contains a component arrangement that allows for the vaporization of dried solid compound and liquid compounds with a low viscosity into an inhalable aerosol. The present invention accomplishes this through the inclusion of specially designed ceramic heating element that replaces the atomizer and an elastic plate for retaining the vaporizable material to said ceramic heating element. Furthermore, the present invention is provided as a reusable attachment piece for existing electronic cigarettes/personal vaporizers system that utilizes a rechargeable battery source.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
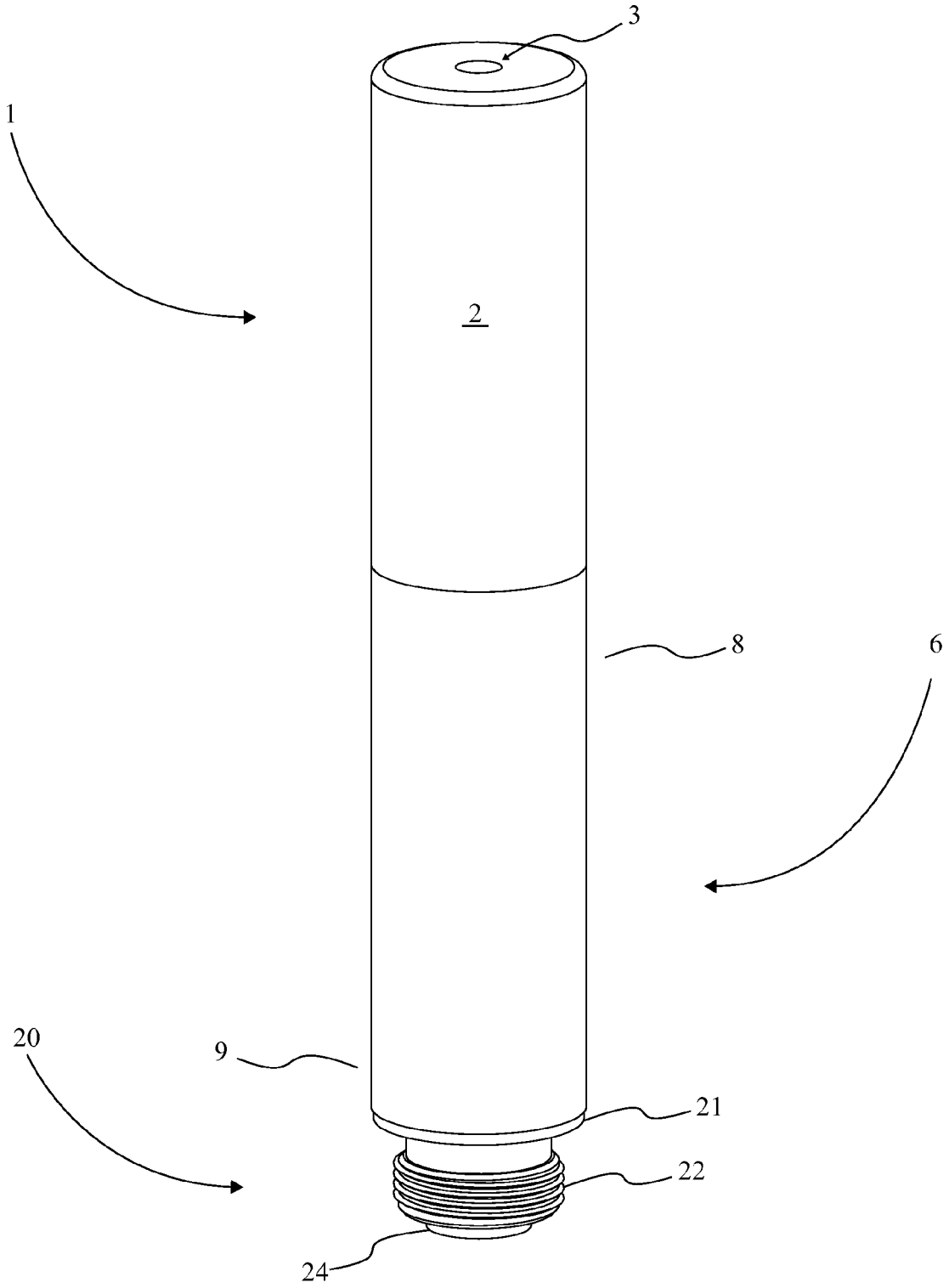
FIG. 1 is a perspective view displaying the portable vaporization apparatus in the loaded configuration as per the current embodiment of the present invention.
Figure 2:
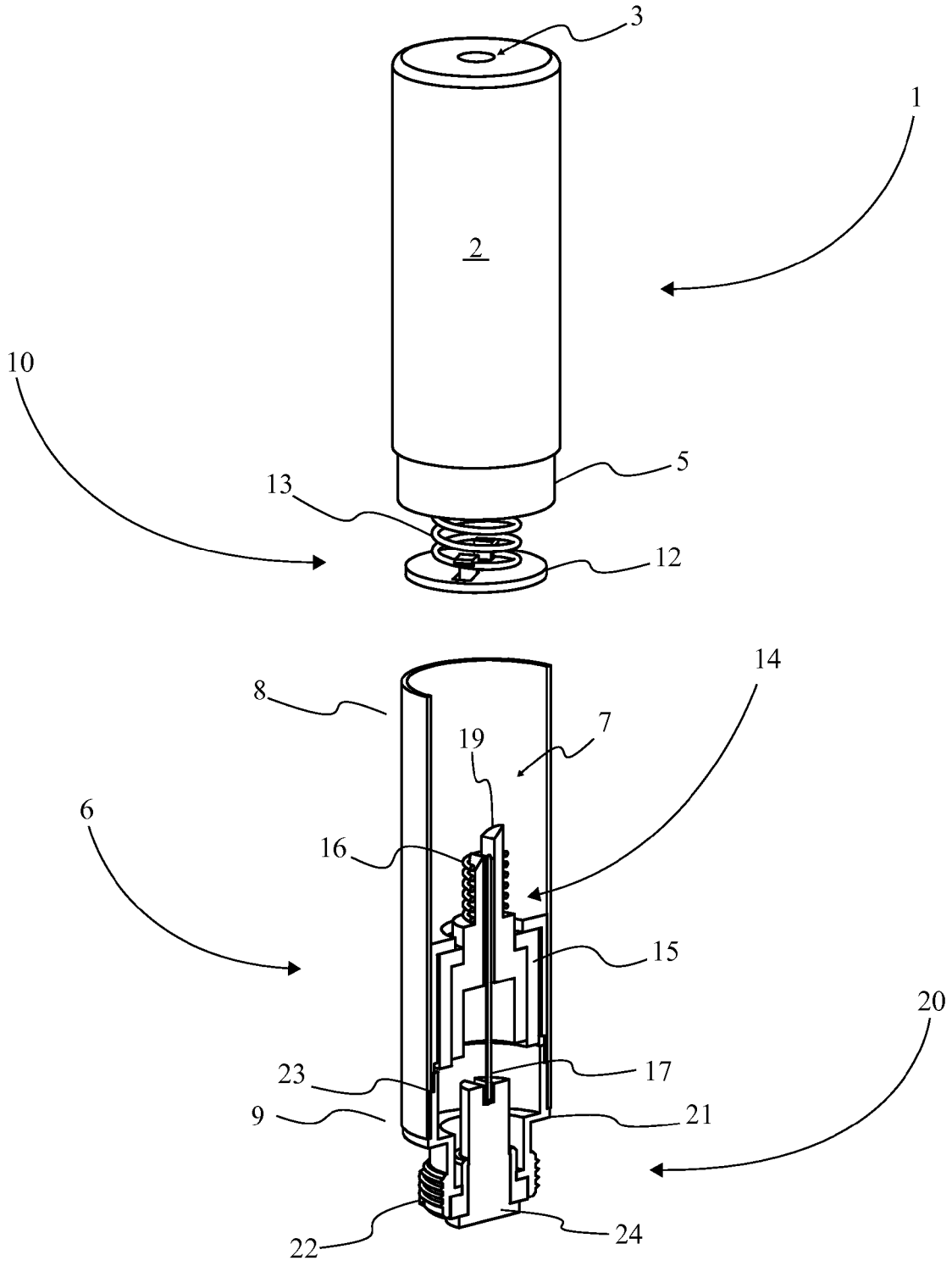
FIG. 2 is a perspective sectional view displaying the component arrangement of the between the mouth piece, the lower housing, the elastic plate, the wickless ceramic heating element, and the battery mount as per the current embodiment of the present invention.

Referencing FIG. 1 and FIG. 2, the present invention is a portable vaporization apparatus that attaches to the electrical source of existing electronic cigarette/personal vaporizer systems and is capable of vaporizing dried solid compounds and fluid compounds. The apparatus comprises a mouth piece 1, a lower housing 6, an elastic plate 10, a wickless ceramic heating element 14, and a battery mount 20. The mouth piece 1 functions as the component that is engaged by the user's mouth in order to inhale the vaporized compounds. The elastic plate 10 functions as the component that retains the vaporizable material against the wickless ceramic heating element 14. The lower housing 6 is provided as an enclosure for containing the vaporizable material, as well as an attachment point for the battery mount 20 and the mouth piece 1. The wickless ceramic heating element 14 is the heat source that heats vaporizable material such as dried solid compounds and fluid compounds. The battery mount 20 is the attachment point utilized to connect the present invention, to an electrical source which provides power to the wickless ceramic heating element 14. In the current embodiment of the present invention, the mouth piece 1, the lower housing 6, the elastic plate 10, the wickless ceramic heating element 14, and the battery mount 20 are found centrally aligned to each other. The central alignment provides a collinear arrangement through a midline for the mouth piece 1, the lower housing 6, the elastic plate 10, the wickless ceramic heating element 14, and the battery mount 20. The mouth piece 1 is found detachably coupled to the lower housing 6. The detachable coupling seals the upper portion 8 of the lower housing 6. The elastic plate 10 is found sleeved by the mouth piece 1 and the lower housing 6. The elastic plate 10 being elastically engaged to the mouth piece 1, wherein the elastic engagement provides the elastic plate 10 as being moveably positioned within the lower housing 6. The wickless ceramic heating element 14 is found positioned centrally within the lower housing 6. The wickless ceramic heating element 14 is found surrounded by the lower housing 6. The lower housing 6 being hermetically coupled to the battery mount 20 opposite the mouth piece 1.

Figure 6:
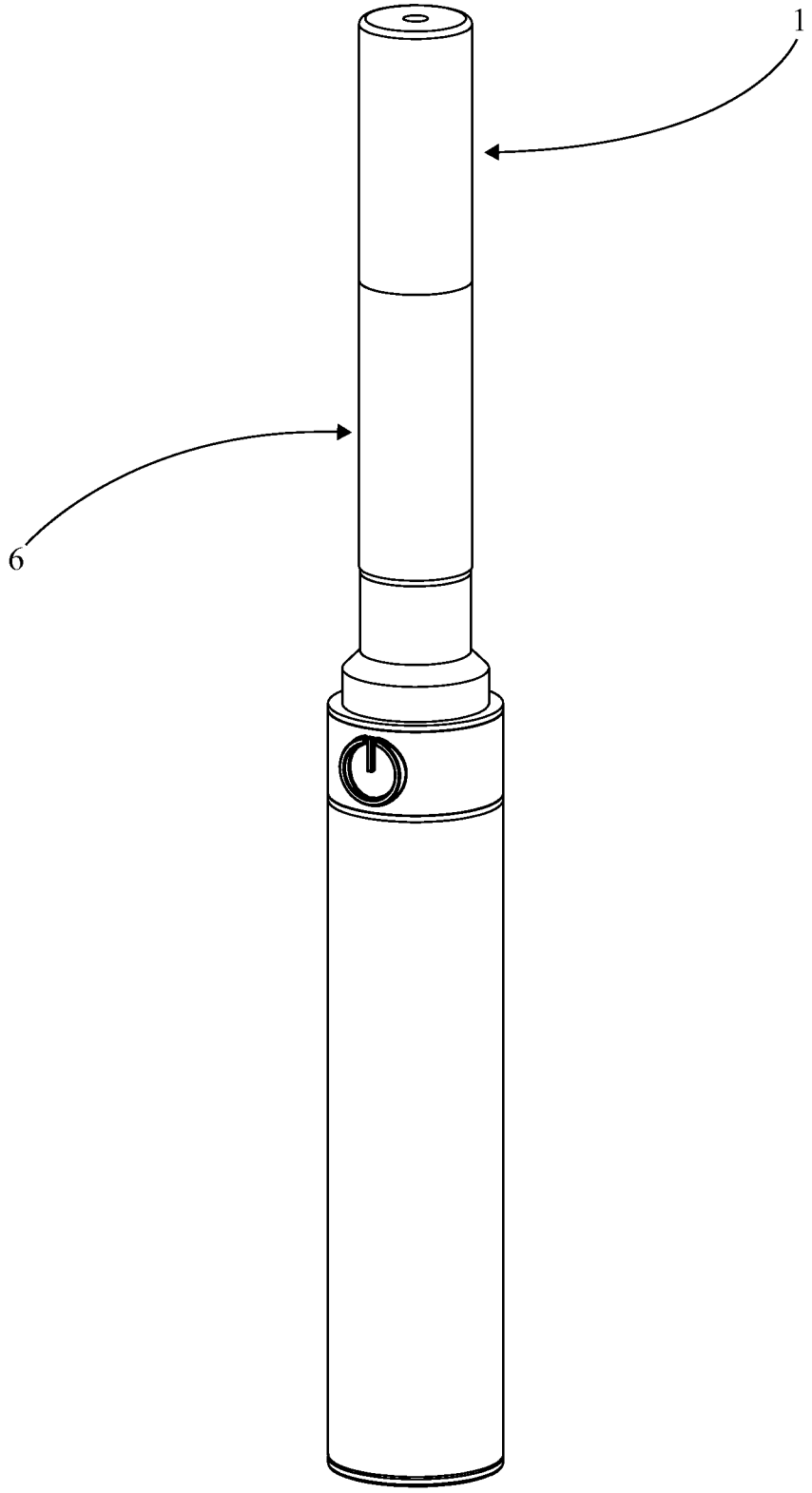
FIG. 6 is a perspective view displaying the portable vaporization apparatus coupled to an electrical source in the activated configuration as per the current embodiment of the present invention.

Referencing FIG. 1, FIG. 2, and FIG. 6, the component arrangement for the portable vaporization apparatus provides the apparatus with three operative states. These operative states comprise a preparation state, a loaded state, and an activated state. The preparation state is the functional state of the present invention where the user is removing vaporized material and loading vaporizable compound in the interior portion of the lower housing 6. The preparation state is characterized by having the apparatus detached from an electrical source and the mouth piece 1 detached from the lower housing 6. In order to progress into the loaded state and the activated state, the present invention must always pass through the preparation state. The loaded state is the brief state where the vaporizable material is positioned within the interior portion of the lower housing 6. The loaded state is characterized by having the mouth piece 1 coupled to the upper portion 8 of the lower housing 6 and the elastic plate 10 retaining the vaporizable material in close proximity to the wickless ceramic heating element 14. The activated state is the operative state where the dry solid compound or the liquid compounds are converted into an inhalable aerosol. The activated state is characterized by having the lower housing 6 being coupled to an electrical source and the battery mount 20 being electrically engaged with the electrical source and the wickless ceramic heating element 14.

Figure 3:
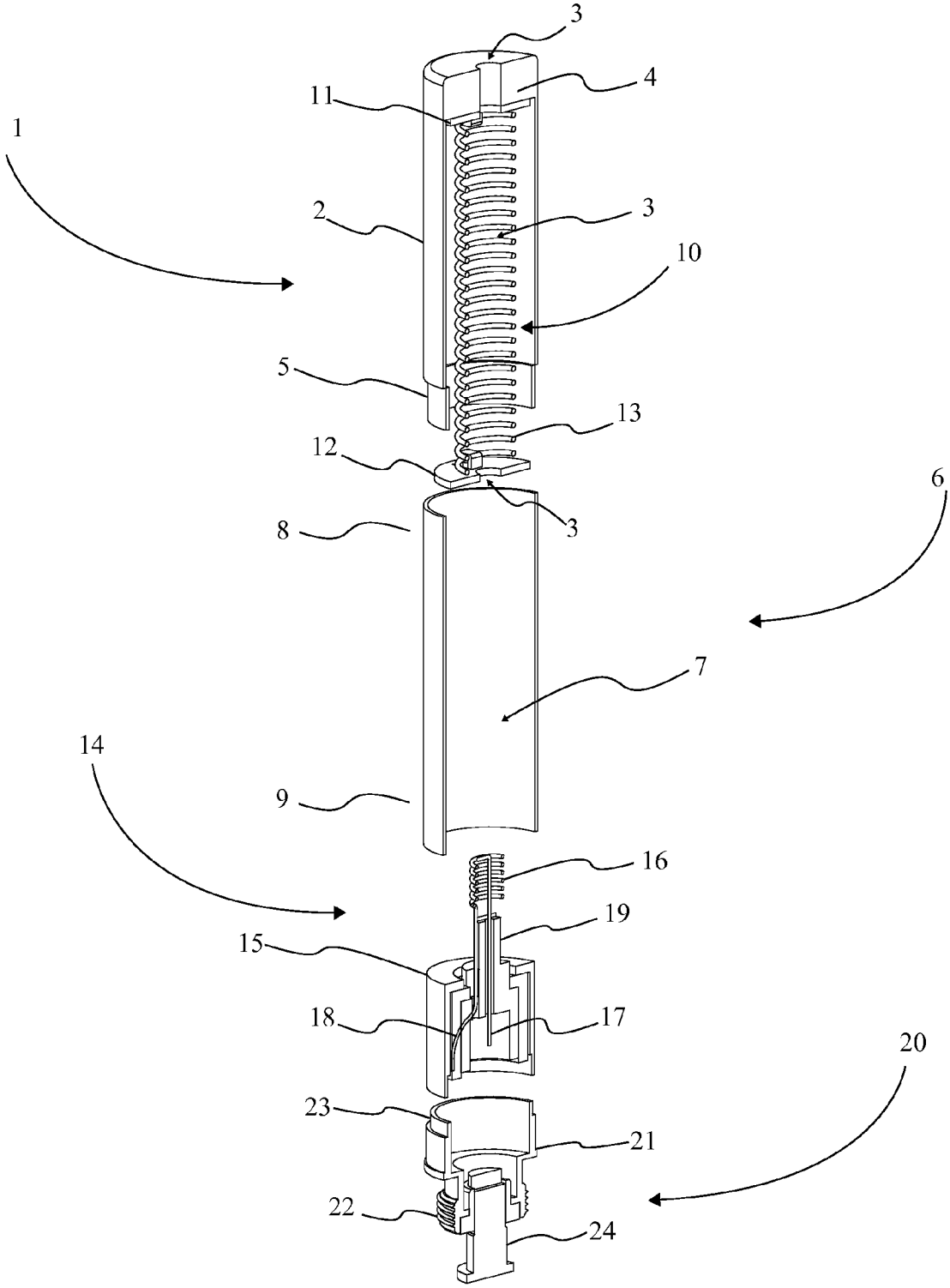
FIG. 3 is an expanded perspective sectional view displaying the component positioning of the current embodiment of the present invention.
Figure 4:
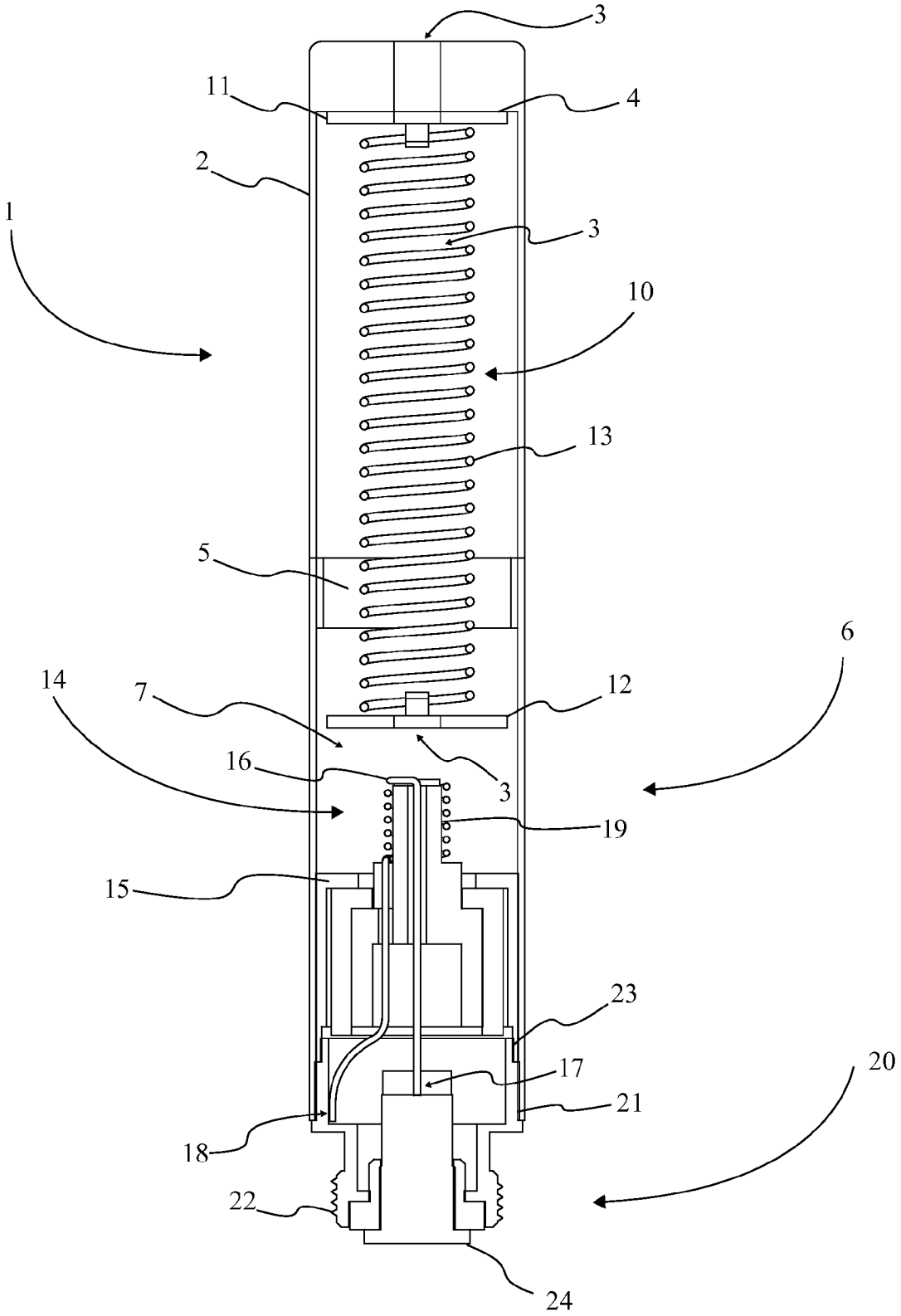
FIG. 4 is a sectional view displaying the internal component distribution in the loaded configuration as per the current embodiment of the present invention.
Figure 5:
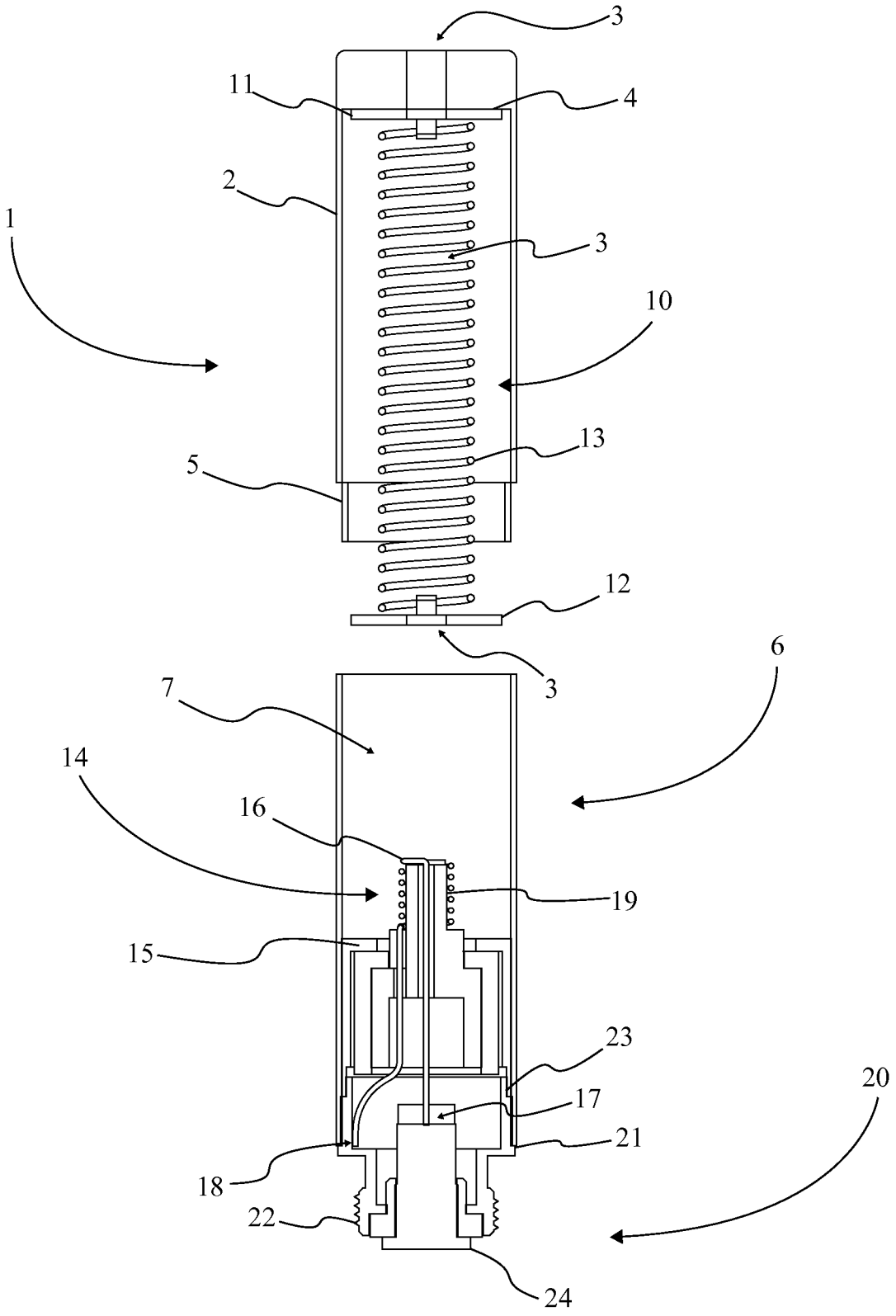
FIG. 5 is a partial expanded sectional view displaying the component distribution in the preparation state as per the current embodiment of the present invention.

Referencing FIG. 3-5, the mouth piece 1 is the component that a user puts their mouth on in order to inhale the vaporized compounds. The mouth piece 1 comprises a cylindrical body 2, an air passage 3, an elastic plate mount 4, and a lower housing mount 5. The cylindrical body 2 is functions as the housing and engagement point for the elastic plate mount 4 and the lower housing mount 5. The air passage 3 is provided as the exhaust point for the vaporized material. The elastic plate mount 4 is the attachment point for the elastic plate 10. The lower housing mount 5 is the attachment point for the mouth piece 1 to the lower housing 6. The lower housing mount 5 is provided with a means to detachably couple to the lower housing 6. In the current embodiment of the present invention, the lower housing mount 5 is found circumferentially position on the cylindrical body 2. The lower housing mount 5 is provided as a lower section of the mouth piece 1 that is complementarily sized and subsequently sleeved by the upper portion 8 of the lower housing 6. The elastic plate mount 4 is found centrally positioned on the cylindrical body 2 opposite the lower housing mount 5. The elastic plate mount 4 is concentrically aligned to the mouth piece 1. The elastic plate mount 4 is found positioned within the mouth piece 1. The cylindrical body 2, the lower housing mount 5, and the elastic plate mount 4 being centrally traversed by the air passage 3. The air passage 3 traverses the cylindrical body 2 of the mouth piece 1 longitudinally. The air passage 3 is centrally positioned in relation to the cylindrical body 2 as well as the elastic plate mount 4 and the lower housing mount 5. The elastic plate 10 is found centrally traversed by the air passage 3, wherein the air passage 3 is maintained unobstructed by the elastic plate 10 by way of a centrally positioned channel that is coincident with air passage 3. The elastic plate 10 is concentrically coupled to the elastic plate mount 4 by way of an upper plate 11. The lower housing mount 5 is detachably coupled to the upper portion 8 of the lower housing 6.

Referencing FIG. 3-5, the elastic plate 10 is a retaining plate that holds vaporizable material against the wickless ceramic heating element 14 as well as providing restricted air flow during the vaporization process. The elastic plate 10 comprises an upper plate 11, a lower plate 12, and a spring 13. The upper plate 11 is provided as the attachment point to the mouth piece 1, wherein the upper plate 11 is found coupled to an elastic plate mount 4 of the mouth piece 1. The lower plate 12 is provided as the contacting plate that retains the vaporizable material near the ceramic heating element. Both the upper plate 11 and the lower plate 12 are centrally traversed by an air passage 3 opening. The lower plate 12 and the upper plate 11 are coupled to each other by way of the spring 13. The spring 13 is the elastic element that allows the lower plate 12 to engage a plurality of differently sized vaporizable materials. The spring 13 is centrally aligned with the upper plate 11 and the lower plate 12 resulting in the collinear alignment of the lower plate 12 opening and the upper plate 11. In the current embodiment of the present invention, the upper plate 11 the lower plate 12 and the spring 13 are centrally aligned to each other. The spring 13 is found positioned between the upper plate 11 and the lower plate 12. The upper plate 11 is elastically engaged to the lower plate 12 by way of the spring 13, wherein, the distance between the upper plate 11 and the lower plate 12 is variable due to the compression of the spring 13. The lower plate 12 being elastically positioned adjacent the wickless ceramic heating element 14, wherein the elastic positioning is used to retain vaporizable material near the wickless ceramic heating element 14 during use. The upper plate 11, the lower plate 12, and the spring 13 are centrally traversed by the air passage 3, enabling the air passage 3 to be coincident with vaporized material.

Referencing FIG. 2-4, the lower housing 6 is the component that houses operative elements of the portable vaporization apparatus. The lower housing 6 is cylindrically shaped and comprises an interior chamber 7. The lower housing 6 is bisected into an upper portion 8 and a lower portion 9. The upper portion 8 of the lower housing 6 provides a detachable coupling for the mouth piece 1 while the lower portion 9 provides a mounting point for the battery. In the current embodiment of the present invention, the interior chamber 7 is found surrounded by the upper portion 8 and the lower portion 9. The interior chamber 7 is provided as an interstitial space that functionally interacts with the ceramic heating element and the elastic plate 10 in order to heat the vaporizable material while preventing combustion. The upper portion 8 sleeves the lower housing mount 5 of the mouth piece 1 providing a detachable engagement between the lower housing 6 and the mouth piece 1. The interior chamber 7 is found sealed by the battery mount 20 and the ceramic heating element coincident with the lower portion 9. The lower plate 12 is found positioned within the interior chamber 7. In the preparation state the interior chamber 7 is made accessible by the removal of the mouth piece 1 and the elastic plate 10. During the preparation state and the loaded state the interior chamber 7 contains vaporizable material that is compressed against the wickless ceramic heating element 14 by way of the elastic plate 10. The attachment of the battery mount 20 to the lower portion 9 enables the wickless ceramic heating element 14 be centrally positioned within the lower portion 9 of the interior chamber 7. In the activated state the interior chamber 7 contains gases from the vaporized compounds that are able to escape through the coincident alignment of the air passage 3. It should be noted that to ensure a proper seal for the battery mount 20 and the wickless ceramic heating element 14, the attachment point for the wickless ceramic heating element 14 with the lower housing 6, and the battery mount 20 with the lower housing 6 are provided with a plurality of heat resistant gaskets in order to ensure a hermetic seal.

Referencing FIG. 2-5, the wickless ceramic heating element 14 is provided as the means of converting the vaporizable materials into a form of inhalable aerosol, wherein the vaporizable materials comprise dry solid compounds as well as liquid compounds. The wickless ceramic heating element 14 is found positioned coincident with the lower portion 9 of the lower housing 6 specifically within the interior chamber 7. In order to create an inhalable aerosol, vaporizable materials are positioned within the interior chamber 7 and are elastically retained against the wickless ceramic heating element 14 by way of the elastic plate 10. In the current embodiment of the present invention, the wickless ceramic heating element 14 comprises a ceramic base 15, a coiled heating element 16, and a concentric protrusion 19. The ceramic base 15 is a thermally conductive cylindrically shaped component that provides a mounting point for the concentric protrusion 19. The concentric protrusion 19 is an extension of the ceramic base 15 that provides a raised structure that is engaged by the coiled heating element 16. The concentric protrusion 19 is found positioned normal to the ceramic base 15, wherein the normal positioning provides the concentric protrusion 19 as a centrally positioned raised structure that is perpendicular to the ceramic base 15. The coiled heating element 16 is helically positioned around the concentric protrusion 19, wherein the coiled heating element 16 is found wrapped around the concentric protrusion 19. The coiled heating element 16 is an electrically conductive compound that functions as a resistor in an electrical system. The coiled heating element 16 comprises a first end 17 and a second end 18, wherein both the first end 17 and the second end 18 contact the battery mount 20. The first end 17 and the second end 18 are found traversing through the ceramic base 15, wherein the first end 17 and the second end 18 traverse the ceramic base 15 in order to engage the battery mount 20. The first end 17 of the coiled heating element 16 is found positioned coincident with the battery mount 20 by way of a contact pin 24. It should be noted that the coupling between the coiled heating element 16 and the battery mount 20 additionally causes the coiled heating element 16 to slightly rise up from its positioning with the concentric protrusion 19. The second end 18 of the coiled heating element 16 is found positioned coincident with the battery mount 20 by way of a threaded engagement 22. During the activated state both the first end 17 and the second end 18 are found coupled to the battery mount 20. The first end 17 functions as an electrical contact while the second end 18 function as the ground. The engagement between the first end 17 and the second end 18 allow the coiled heating element 16 to function as a component of an electrical system. Upon receiving an electrical current from the battery mount 20, the first electrical heating element coverts electrical energy in to thermal energy. The thermal energy generated by the coiled heating element 16 is transferred as heat the ceramic base 15 which provides a larger surface area in order to better heat the vaporizable material.

Referencing FIG. 3-6, the battery mount 20 functions as an attachment point to an electrical source. The battery mount 20 provides a means of engaging the electrical source as well as a means of electrically engaging the electrical source in order to power the wickless ceramic heating element 14. The battery mount 20 is securely engaged to the lower portion 9 of the lower housing 6 wherein the secure engagement is provided with a hermetic seal between the battery mount 20 and the lower portion 9 of the lower housing 6 in order to reduce unwanted air flow into the interior chamber 7, where reduced unwanted air flow reduces combustion of the vaporizable material. In the current embodiment of the present invention, the battery mount 20 comprises a housing coupler 21, a threaded engagement 22, a heating element mount 23, and a contact pin 24. The housing coupler 21 is provided as the engagement point between the lower housing 6 and the battery mount 20. The threaded engagement 22 functions as the detachable engagement point between the portable vaporization apparatus and an electrical source. The heating element mount 23 is provided as the attachment point that securely and hermetically engages the wickless ceramic heating element 14. The heating element mount 23 is provided with a coincident engagement with the contact pin 24. The contact pin 24 is a terminal that electrically engages the electrical source. The housing coupler 21 is found positioned concentric to the heating element mount 23. The housing coupler 21 is positioned opposite the threaded engagement 22. The housing coupler 21 is sleeved by the lower portion 9 of the lower housing 6. The contact pin 24 is found retractably engaged to the threaded engagement 22, wherein the retractable engagement provides the contact pin 24 with a means of becoming coincident with the first end 17 of the coiled heating element 16. The heating element mount 23 is securely engaged to the ceramic base 15 opposite the concentric protrusion 19. The heating element mount 23 is found positioned opposite the threaded engagement 22. The contact pin 24 being electrically coupled to the first end 17 of the coiled heating element 16. The threaded engagement 22 being electrically coupled to the second end 18 of the coiled heating element 16. The contact pin 24 is found centrally positioned on the battery mount 20 opposite the heating element mount 23. During the activated state the contact pin 24 is electrically engaged with the terminal of an electrical source. The engagement additionally results in the partial movement of the contact pin 24 permitting a temporary engagement with the first end 17 of the coiled heating element 16. During the activated state, the contact pin 24 is coincident with the first end 17 while the second end 18 is grounded to the heating element mount 23. During the preparation state and the loaded state the first end 17 is found decoupled to the contact pin 24 while the second end 18 is found coincident with the heating element mount 23.

Referencing FIG. 2-6, the current embodiment of the present invention, a user would initiate the use of the portable vaporization apparatus in the preparation state. In the preparation state the mouth piece 1 would be detached from the lower housing 6 while the battery mount 20 was disengaged to an electrical source. The user would vertically orient the lower housing 6, positioning the battery mount 20 adjacent to the ground and providing access to the interior chamber 7. The user would position vaporizable material within the interior chamber 7. The user would then attach the mouth piece 1 to the upper portion 8 of the lower housing 6 by way of the lower housing mount 5. with the lower housing mount 5 coupled to the upper portion 8 of the lower housing 6, the lower plate 12 would be found positioned within the interior chamber 7 of the lower housing 6. The lower plate 12 would be elastically retaining the vaporizable material by way of the spring 13 in order to compress the vaporizable material near the wickless ceramic heating element 14. Upon coupling the mouth piece 1 to the lower housing 6 containing the vaporizable material, the portable vaporization apparatus is said to be in the loaded state. With the portable vaporization apparatus in the loaded state, the air passage 3 that centrally traverses the elastic plate 10 and mouth piece 1 becomes coincident with vaporizable material and the wickless ceramic heating element 14. To transition the portable vaporization apparatus to the activated state, the user would connect an electrical source to the battery mount 20. The battery mount 20 would align with an electrical source containing a complementary threaded engagement 22 and a centrally positioned node. The complementary threaded engagement 22 detachably couples to the threaded engagement 22 of the battery mount 20. Upon coupling the threaded engagement 22 to the complementary threaded engagement 22, the centrally positioned node engages the contact pin 24. The contact pin 24 being movably engaged to the battery mount 20, retracts within the battery mount 20 becoming coincident with the first end 17 of the coiled heating element 16. The coincident engagement causes the first end 17 to function as an electrical terminal for the coiled heating element 16. It should be noted that during the engagement of the first end 17 with the contact pin 24, the second end 18 of the coiled heating element 16 maintains its coincident engagement with the threaded engagement 22. With the electrical source engaged to the battery mount 20, electrical current from the electrical source traverses across the centrally positioned node and the contact pin 24 reaching the first end 17 of the coiled heating element 16. The coiled heating element 16 functions as a resistor and coverts the electrical current into thermal energy. The thermal energy generated by the coiled heating element 16 is transferred to the concentric protrusion 19 and the ceramic base 15. With the lower plate 12 compressing the vaporizable material against the wickless ceramic heating element 14. with the air tight engagement between battery mount 20 and the lower housing 6 the heated vaporizable material is unable to obtain sufficient oxygen in order to combust enabling the wickless ceramic heating element 14 to reach the vaporization temperature of the vaporizable material. Upon vaporization, the user would place their mouth on the mouth piece 1 and align the air passage 3 in order to inhale the vaporized gases found within the interior chamber 7 of the lower housing 6. Upon vaporizing all of the vaporizable material, the user would disconnect the portable vaporization apparatus from the electrical source and detach the mouth piece 1 from the lower housing 6, the user would then dispose of any vaporized material left within the interior chamber 7. Upon disposing of the vaporized material the user would have cycled back to the preparation state.

In the current embodiment of the present invention the electrical source can best be described as a portable rechargeable battery. The portable rechargeable battery contains an electrical terminal and a complimentary threaded engagement 22 for coupling with the battery mount 20. While specific battery features are not explicitly described it should be understood that the electrical source could be provided as any attachable battery system that can be engaged with the current embodiment of the present invention in a manner that would allow the invention to effectively heat and therefore vaporize a plurality of vaporizable material positioned within the interior chamber 7.

In the current embodiment of the present invention the material construction for the mouth piece 1, the elastic plate 10, the lower housing 6, and the battery mount 20 was selected according to the specific function of each component. Although the materials selected are not explicitly described it should be understood any materials that permits the present invention from functioning in the manner described could potentially be used or substituted. Furthermore, it should be noted that while the material construction for the wickless ceramic heating element 14 is described, that an exact material construction for the coiled heating element 16 is not provided. It should be understood that this subcomponent's material construction could potentially be provided by any material that allows the coiled heating element 16 to optimally function within the present invention.

In the current embodiment of the present invention, the vaporizable material consists of dried solid compounds and fluid compounds. While the exact composition of the dried solid compound is not explicitly described, it should be noted that any dried solid compound could potentially be utilized by the portable vaporization apparatus. These dried solid compounds can include but are not limited to herbaceous matter, such as dried herbs and spices, crystalline extracts or compounds, such as dried flavored nicotine containing compounds as well as any combination thereof. Furthermore while the exact composition of the fluid compounds is not explicitly described, it should be noted that any fluid compound could potentially be utilized by the portable vaporization apparatus. These fluid compounds can include but are not limited to essential oils, extract solutions, as well as any combination thereof.

Although the invention has been explained in relation to its preferred embodiment, it is to be understood that many other possible modifications and variations can be made without departing from the spirit and scope of the invention as hereinafter claimed.

What is claimed is:

1. A portable vaporization apparatus comprises:
- a mouth piece;
- a lower housing;
- an elastic plate;
- a wickless ceramic heating element;
- a battery mount;
- the mouth piece comprises a cylindrical body, an air passage, an elastic plate mount, and a lower housing mount;
- the lower housing comprises an interior chamber, an upper portion, and a lower portion;
- the elastic plate comprises an upper plate, a lower plate, and a spring;
- the wickless ceramic heating element comprises a ceramic base, a coiled heating element, and a concentric protrusion;
- the battery mount comprises a housing coupler, a threaded engagement, a heating element mount, and a contact pin; and
- the coiled heating element comprises a first end and a second end.

2. The portable vaporization apparatus as claimed in claim 1 comprises:
- the mouth piece, the lower housing, the elastic plate, the wickless ceramic heating element, and the battery mount being centrally aligned to each other, wherein the central alignment provides a collinear arrangement through a midline for the mouth piece, the lower housing, the elastic plate, the wickless ceramic heating element, and the battery mount;
- the mouth piece being detachably coupled to the lower housing;
- the elastic plate being sleeved by the mouth piece and the lower housing;
- the elastic plate being elastically engaged to the mouth piece;
- the wickless ceramic heating element being securely mounted to the battery mount;
- the lower housing being hermetically coupled to the battery mount opposite the mouth piece; and
- the wickless ceramic heating element being surrounded by the lower housing.

3. The portable vaporization apparatus as claimed in claim 1 comprises:
- the lower housing mount being circumferentially positioned on the cylindrical body;

the elastic plate mount being centrally positioned on the cylindrical body opposite the lower housing mount;

the cylindrical body, the lower housing mount, and the elastic plate mount being centrally traversed by the air passage;

the upper plate being concentrically coupled to the elastic plate mount;

the elastic plate being centrally traversed by the air passage; and the lower housing mount being detachably engaged to the upper portion of the lower housing.

4. The portable vaporization apparatus as claimed in claim 1 comprises:

the upper plate, the lower plate, and the spring being centrally aligned to each other;

the spring being positioned between the upper plate and the lower plate;

the upper plate being elastically engaged to the lower plate by way of the spring;

the lower plate being encircled by the lower housing;

the lower plate being elastically positioned adjacent the wickless ceramic heating element; and the upper plate, the lower plate, and the spring being centrally traversed by the air passage.

5. The portable vaporization apparatus as claimed in claim 1 comprises:

the interior chamber being surrounded by the upper portion and the lower portion;

the lower plate being positioned within the interior chamber;

the lower housing mount being sleeved by the upper portion;

the battery mount being hermetically coupled to the lower portion by way of the housing coupler; and the wickless ceramic heating element being positioned within the interior chamber.

6. The portable vaporization apparatus as claimed in claim 1 comprises:

the concentric protrusion being positioned normal on the ceramic base opposite the battery mount;

the coiled heating element being helically positioned around the concentric protrusion;

the coiled heating element being moveably positioned to the concentric protrusion and the ceramic base;

the first end and the second end of the coiled heating element traverse the ceramic base;

the first end of the coiled heating element being positioned coincident with the contact pin; and the second end of the coiled heating element being positioned coincident with the threaded engagement.

7. The portable vaporization apparatus as claimed in claim 1 comprises:

the heating element mount being positioned concentric to the housing coupler;

the housing coupler being positioned opposite the threaded engagement;

the contact pin being retractably engaged to the threaded engagement;

the heating element mount being securely engaged to the ceramic base opposite the concentric protrusion;

the housing coupler being sleeved by the lower portion of the lower housing;

the contact pin being electrically coupled to the first end of the coiled heating element; and the threaded engagement being electrically coupled to the second end of the coiled heating element.

8. A portable vaporization apparatus comprises:

a mouth piece;

a lower housing;

an elastic plate;

a wickless ceramic heating element;

a battery mount;

the mouth piece comprises a cylindrical body, an air passage, an elastic plate mount, and a lower housing mount;

the lower housing comprises an interior chamber, an upper portion, and a lower portion;

the elastic plate comprises an upper plate, a lower plate, and a spring;

the wickless ceramic heating element comprises a ceramic base, a coiled heating element, and a concentric protrusion;

the battery mount comprises a housing coupler, a threaded engagement, a heating element mount, and a contact pin;

the coiled heating element comprises a first end and a second end;

the mouth piece, the lower housing, the elastic plate, the wickless ceramic heating element, and the battery mount being centrally aligned to each other, wherein the central alignment provides a collinear arrangement through a midline for the mouth piece, the lower housing, the elastic plate, the wickless ceramic heating element, and the battery mount;

the mouth piece being detachably coupled to the lower housing;

the elastic plate being sleeved by the mouth piece and the lower housing;

the elastic plate being elastically engaged to the mouth piece;

the wickless ceramic heating element being securely mounted to the battery mount;

the lower housing being hermetically coupled to the battery mount opposite the mouth piece; and the wickless ceramic heating element being surrounded by the lower housing.

9. The portable vaporization apparatus as claimed in claim 8 comprises:

the lower housing mount being circumferentially positioned on the cylindrical body;

the elastic plate mount being centrally positioned on the cylindrical body opposite the lower housing mount;

the cylindrical body, the lower housing mount, and the elastic plate mount being centrally traversed by the air passage;

the upper plate being concentrically coupled to the elastic plate mount;

the elastic plate being centrally traversed by the air passage;

the lower housing mount being detachably engaged to the upper portion of the lower housing;

the upper plate, the lower plate, and the spring being centrally aligned to each other;

the spring being positioned between the upper plate and the lower plate;

the upper plate being elastically engaged to the lower plate by way of the spring;

the lower plate being encircled by the lower housing;

the lower plate being elastically positioned adjacent the wickless ceramic heating element; and the upper plate, the lower plate, and the spring being centrally traversed by the air passage.

10. The portable vaporization apparatus as claimed in claim 8 comprises:

the interior chamber being surrounded by the upper portion and the lower portion;

the lower plate being positioned within the interior chamber;

the lower housing mount being sleeved by the upper portion;

the battery mount being hermetically coupled to the lower portion by way of the housing coupler;

the wickless ceramic heating element being positioned within the interior chamber;

the concentric protrusion being positioned normal on the ceramic base opposite the battery mount;

the coiled heating element being helically positioned around the concentric protrusion;

the coiled heating element being moveably positioned to the concentric protrusion and the ceramic base;

the first end and the second end of the coiled heating element traverse the ceramic base;

the first end of the coiled heating element being positioned coincident with the contact pin; and the second end of the coiled heating element being positioned coincident with the threaded engagement.

11. The portable vaporization apparatus as claimed in claim 8 comprises:

the heating element mount being positioned concentric to the housing coupler;

the housing coupler being positioned opposite the threaded engagement;

the contact pin being retractably engaged to the threaded engagement;

the heating element mount being securely engaged to the ceramic base opposite the concentric protrusion;

the housing coupler being sleeved by the lower portion of the lower housing;

the contact pin being electrically coupled to the first end of the coiled heating element; and the threaded engagement being electrically coupled to the second end of the coiled heating element.

12. A portable vaporization apparatus comprises:

a mouth piece;

a lower housing;

an elastic plate;

a wickless ceramic heating element;

a battery mount;

the mouth piece comprises a cylindrical body, an air passage, an elastic plate mount, and a lower housing mount;

the lower housing comprises an interior chamber, an upper portion, and a lower portion;

the elastic plate comprises an upper plate, a lower plate, and a spring;

the wickless ceramic heating element comprises a ceramic base, a coiled heating element, and a concentric protrusion;

the battery mount comprises a housing coupler, a threaded engagement, a heating element mount, and a contact pin;

the coiled heating element comprises a first end and a second end;

the mouth piece, the lower housing, the elastic plate, the wickless ceramic heating element, and the battery mount being centrally aligned to each other, wherein the central alignment provides a collinear arrangement through a midline for the mouth piece, the lower housing, the elastic plate, the wickless ceramic heating element, and the battery mount;

the mouth piece being detachably coupled to the lower housing;

the elastic plate being sleeved by the mouth piece and the lower housing;

the elastic plate being elastically engaged to the mouth piece;

the wickless ceramic heating element being securely mounted to the battery mount;

the lower housing being hermetically coupled to the battery mount opposite the mouth piece;

the wickless ceramic heating element being surrounded by the lower housing;

the lower housing mount being circumferentially positioned on the cylindrical body;

the elastic plate mount being centrally positioned on the cylindrical body opposite the lower housing mount;

the cylindrical body, the lower housing mount, and the elastic plate mount being centrally traversed by the air passage;

the upper plate being concentrically coupled to the elastic plate mount;

the elastic plate being centrally traversed by the air passage;

the lower housing mount being detachably engaged to the upper portion of the lower housing;

the upper plate, the lower plate, and the spring being centrally aligned to each other;

the spring being positioned between the upper plate and the lower plate;

the upper plate being elastically engaged to the lower plate by way of the spring;

the lower plate being encircled by the lower housing;

the lower plate being elastically positioned adjacent the wickless ceramic heating element;

the upper plate, the lower plate, and the spring being centrally traversed by the air passage;

the interior chamber being surrounded by the upper portion and the lower portion;

the lower plate being positioned within the interior chamber;

the lower housing mount being sleeved by the upper portion;

the battery mount being hermetically coupled to the lower portion by way of the housing coupler;

the wickless ceramic heating element being positioned within the interior chamber;

the concentric protrusion being positioned normal on the ceramic base opposite the battery mount;

the coiled heating element being helically positioned around the concentric protrusion;

the coiled heating element being moveably positioned to the concentric protrusion and the ceramic base;

the first end and the second end of the coiled heating element traverse the ceramic base;

the first end of the coiled heating element being positioned coincident with the contact pin;

the second end of the coiled heating element being positioned coincident with the threaded engagement;

the heating element mount being positioned concentric to the housing coupler;

the housing coupler being positioned opposite the threaded engagement;

the contact pin being retractably engaged to the threaded engagement;

the heating element mount being securely engaged to the ceramic base opposite the concentric protrusion;

the housing coupler being sleeved by the lower portion of the lower housing;

the contact pin being electrically coupled to the first end of the coiled heating element; and the threaded engagement being electrically coupled to the second end of the coiled heating element.

* * * * *